US005936650A

United States Patent [19]

Ouchida et al.

[11] Patent Number: 5,936,650

[45] Date of Patent: Aug. 10, 1999

[54] INK DELIVERY SYSTEM FOR INK-JET PENS

[75] Inventors: Donald B. Ouchida; Bruce Cowger; Ronald W. Hall, all of Corvallis; Daniel D. Dowell, Albany, all of Oreg.

[73] Assignee: Hewlett Packard Company, Palo Alto, Calif.

[21] Appl. No.: 08/805,303

[22] Filed: Feb. 25, 1997

Related U.S. Application Data

[63] Continuation-in-part of application No. 08/449,316, May 24, 1995, abandoned.

[51] Int. Cl.[6] ..... B41J 2/18

[52] U.S. Cl. ..... 347/89

[58] Field of Search ..... 347/89, 92, 29, 347/85, 86, 87

[56] References Cited

U.S. PATENT DOCUMENTS

| | | | |
|---|---|---|---|
| 4,187,511 | 2/1980 | Robinson | 347/7 |
| 4,190,426 | 2/1980 | Ruschke | 55/185 |
| 4,383,263 | 5/1983 | Ozawa et al. | 347/30 |
| 4,494,124 | 1/1985 | Piatt et al. | 347/89 |
| 4,502,054 | 2/1985 | Brescia et al. | 347/55 |
| 4,623,905 | 11/1986 | Ichihashi et al. | 347/86 |
| 4,631,554 | 12/1986 | Terasawa | 347/38 |
| 4,677,447 | 6/1987 | Nielsen | 347/87 |
| 4,791,438 | 12/1988 | Hanson et al. | 347/87 |
| 4,794,409 | 12/1988 | Cowger et al. | 347/87 |
| 4,801,954 | 1/1989 | Miura et al. | 347/21 |
| 4,814,786 | 3/1989 | Hoisington et al. | 347/88 |
| 4,896,172 | 1/1990 | Nozawa et al. | 347/89 |
| 4,929,963 | 5/1990 | Balazar | 347/89 |
| 4,931,811 | 6/1990 | Cowger et al. | 347/87 |
| 4,931,814 | 6/1990 | Yoshimura | 347/86 |
| 4,937,598 | 6/1990 | Hine et al. | 347/89 |
| 4,967,207 | 10/1990 | Ruder | 347/7 |
| 4,968,998 | 11/1990 | Allen | 347/7 |
| 4,992,802 | 2/1991 | Dion et al. | 347/87 |
| 4,998,115 | 3/1991 | Nevarez et al. | 347/35 |
| 4,999,652 | 3/1991 | Chan | 347/86 |
| 5,006,867 | 4/1991 | Koizumi et al. | 347/17 |
| 5,010,354 | 4/1991 | Cowger et al. | 347/87 |
| 5,016,023 | 5/1991 | Chan et al. | 347/42 |
| 5,091,737 | 2/1992 | Toganoh et al | 347/42 |
| 5,121,130 | 6/1992 | Hempel et al. | 347/89 |
| 5,153,612 | 10/1992 | Dunn et al. | 347/87 |
| 5,159,348 | 10/1992 | Dietl et al. | 347/89 |
| 5,185,614 | 2/1993 | Courian et al. | 347/24 |
| 5,236,989 | 8/1993 | Brown et al. | 524/413 |
| 5,278,584 | 1/1994 | Keefe et al. | 347/63 |
| 5,291,215 | 3/1994 | Nozawa et al. | 347/18 |

FOREIGN PATENT DOCUMENTS 2134040 12/1983 United Kingdom .

*Primary Examiner*—N. Le
*Assistant Examiner*—Michael Nghiem

[57] ABSTRACT

An ink delivery system for an ink-jet pen having a print head with ink nozzles and a cartridge with an internal reservoir divided into a capillary material filled volume and a free standpipe volume. The print head is mounted on the cartridge adjacent the standpipe volume. The ink delivery system further includes a circulation conduit removably connected to the standpipe volume and the capillary material filled volume to permit fluid flow from the standpipe volume to the capillary material filled volume. A supply conduit connects an ink supply to the circulation conduit. A pump connected to the circulation conduit pumps ink from the ink supply through the circulation conduit to the capillary material filled volume. The pump further operates to pump fluid from the standpipe volume through the circulation conduit and to the capillary material-filled volume thereby filling the cartridge with ink, removing gas bubbles from the cartridge, priming the print head nozzles, and dissipating heat generated by the print head.

28 Claims, 7 Drawing Sheets

INK DELIVERY SYSTEM FOR INK-JET PENS

This is a continuation-in-part of U.S. patent application Ser. No. 08/449,316, filed May 24, 1995, now abandoned.

FIELD OF THE INVENTION

The present invention relates to ink delivery, air removal and heat dissipation within pens for ink-jet printers.

BACKGROUND AND SUMMARY OF THE INVENTION

Ink-jet printers have become widely accepted as reliable and inexpensive means of high-quality printing. A typical ink-jet pen has a print head having a plurality of nozzles through which ink droplets are ejected. Adjacent to the nozzles are ink firing chambers where ink is stored prior to ejection. Ink is delivered to the firing chambers through ink channels in fluid communication with an ink supply. The ink supply may be, for example, contained in a reservoir part of the pen. During printing, ink located in the firing chamber is heated or vaporized by a heat transducer, such as a thin film resistor. Formation of the ink vapor bubble is known as nucleation. The rapid expansion of the vaporized ink forces a drop of ink through the nozzle.

One type of ink-jet printer includes a carriage that is reciprocated across a sheet of paper that is advanced through the printer. The reciprocating carriage holds a pen very close to the paper. The pen is controlled by the printer for selectively ejecting the ink drops from the pen while the pen is reciprocated or scanned across the paper, thereby to produce characters or an image on the paper. Typically, when carried on a reciprocated carriage, the pen will have a small reservoir for holding a limited amount of ink. A relatively larger supply of ink is provided in a stationary container that is mounted to the printer and is permanently or occasionally connected to the pen.

An important design consideration for ink-jet printers is to maximize the printing speed. One method of increasing the speed of the printing operation is to increase the velocity with which the pen is scanned across the paper. Reducing the weight of the pen, including the ink reservoir connected to the pen, permits high velocity scanning of the pen while minimizing the power requirements of the motor that drives the carriage.

In order to print effectively, the firing chambers and nozzles need to be "primed" with ink. Typically, priming includes moving ink into the firing chambers. Ink is moved to and held within the chambers and nozzles by capillary force. Priming does not occur spontaneously as ink is first added to a pen. Air bubbles lodged in and around the firing chambers may act to prevent spontaneous priming. Priming tends to be even more problematic in pens that store ink under a slight back pressure. As used herein, the term "back pressure" means a partial vacuum within the pen. In such systems, the presence of a back pressure ensures ink is expelled only when the print head is activated (i.e., when ink is ejected). However, the slight back pressure is not so high as to impede the movement of ink into the firing chambers and nozzles.

A specific priming operation is usually provided to prime the print head of an ink-jet pen. Such priming usually takes place in ink-jet pen factories by inverting the pen after it has been filled with ink and sucking air and ink through the print head nozzles. While such factory priming works well, it has a number of disadvantages. For instance, special low-water-loss packaging is required to prevent nozzle dry-out in factory-primed pens. In addition, factory-primed pens have a limited shelf life of about 18 months, after which the ink quality may degrade due to water loss. Additionally, print head adhesives that are used for sealing the nozzles prior to use may fail due to corrosive characteristics of the ink. Moreover, a factory-primed pen, once installed in a printer, is not designed for repriming in the event that one or more print head nozzles become de-primed.

Systems for priming ink-jet pens while the pens are installed in a printer have been developed. These systems solve some of the problems associated with factory-primed pens. Such in-printer systems usually prime pens by sucking ink outwardly through the nozzles of the pens. However, existing in-printer priming systems have disadvantages. For example, the ink that is sucked through the nozzles is sometimes absorbed by a disposable absorbent pad. Thus, ink is wasted and periodic maintenance to replace the absorbent pad is required.

After initial priming of a print head, care must be taken to eliminate air bubbles that are later introduced to or formed within the ink-jet pen. Air bubbles may be introduced when carried in the ink supplied to the pen. Air is diffused throughout most inks. Heat, either ambient or generated by the ink-jet pen, causes dissolved air within the ink to form air bubbles within the pen. Such air bubbles do not readily redissolve when the ink cools. Additionally, air may be introduced to the pen through the nozzles during ink droplet ejection. That is, after the drop is ejected, ink remaining in the firing chamber is drawn back in toward the print head, drawing with it air from outside the print head. Air may also be introduced to the system should the pen be dropped or bumped. Also, the process of capping the pen to prevent ink from flowing through or drying within the nozzles when the pen is not in use may force air into the print head.

The presence of air bubbles within the pen usually leads to print quality problems. An air bubble can obstruct ink flow to particular firing chambers from which ink droplets are to be ejected. Air bubbles can cause irregularly shaped ink droplets or cause a print head to deprime resulting in complete failure of the print head. Consequently, ink-jet print heads should be substantially free of air.

Previous attempts to eliminate the problems caused by air bubbles within the pen system have included storing the air at a location known as the standpipe that is located between the print head and the ink supply or reservoir. However, to allow ink to flow around air stored within the standpipe, the size of the standpipe must be relatively large, in turn requiring an undesirably large pen.

In addition to air bubbles, excessive heat within the ink-jet pen can lead to print quality problems. As discussed above, heat within the pen system may liberate dissolved-gas bubbles in the ink. Additionally, excessive heat within the pen may cause prenucleation of the ink vapor bubble resulting in poor ink droplet formation. Excessive print head heat can also change the composition of the ink through evaporation of various ink components. Such changes in the ink composition may also cause poor droplet formation.

The present invention addresses the above-described traditional thermal ink-jet problems with a single ink delivery system. The present invention provides thermal management within the pen, removal of air bubbles within the system and priming of the ink-jet pen all while the pen is installed in a printer.

According to the present invention, a preferred ink delivery system for an ink-jet pen comprises a pen cartridge having an internal ink reservoir. The cartridge has a fluid inlet and a fluid outlet, both in fluid communication with the reservoir. A circulation conduit connects the fluid outlet and fluid inlet. The circulation conduit permits ink circulation into the fluid inlet, through the reservoir, out of the fluid outlet, through the circulation conduit, and back to the fluid inlet. Such ink circulation delivers ink to the print head, dissipates heat generated within the pen, removes air bubbles throughout the pen system, and primes the print head.

Additionally, the present invention provides for initially filling or refilling an ink-jet pen reservoir. The reservoir refilling operation may be continuous wherein ink is continuously circulated through the ink reservoir. Alternatively, the reservoir refilling operation may be periodic wherein ink is only circulated to the pen reservoir when the ink supply within the pen is low.

Moreover, because the ink delivery system of the present invention facilitates the removal of air bubbles from the standpipe as well as from other areas throughout the pen system, the standpipe size may be reduced. A smaller standpipe yields a smaller ink-jet pen. Thus, a smaller ink-jet pen is provided by the present invention without reducing printer reliability, print speed or print quality.

The present invention also allows priming of the print head without requiring either ink or air to be removed through the print head nozzles. Accordingly, ink is not wasted and traditional disposal of waste ink and waste ink absorbent pads is not necessary.

DESCRIPTION OF PREFERRED EMBODIMENTS

Figure 1:
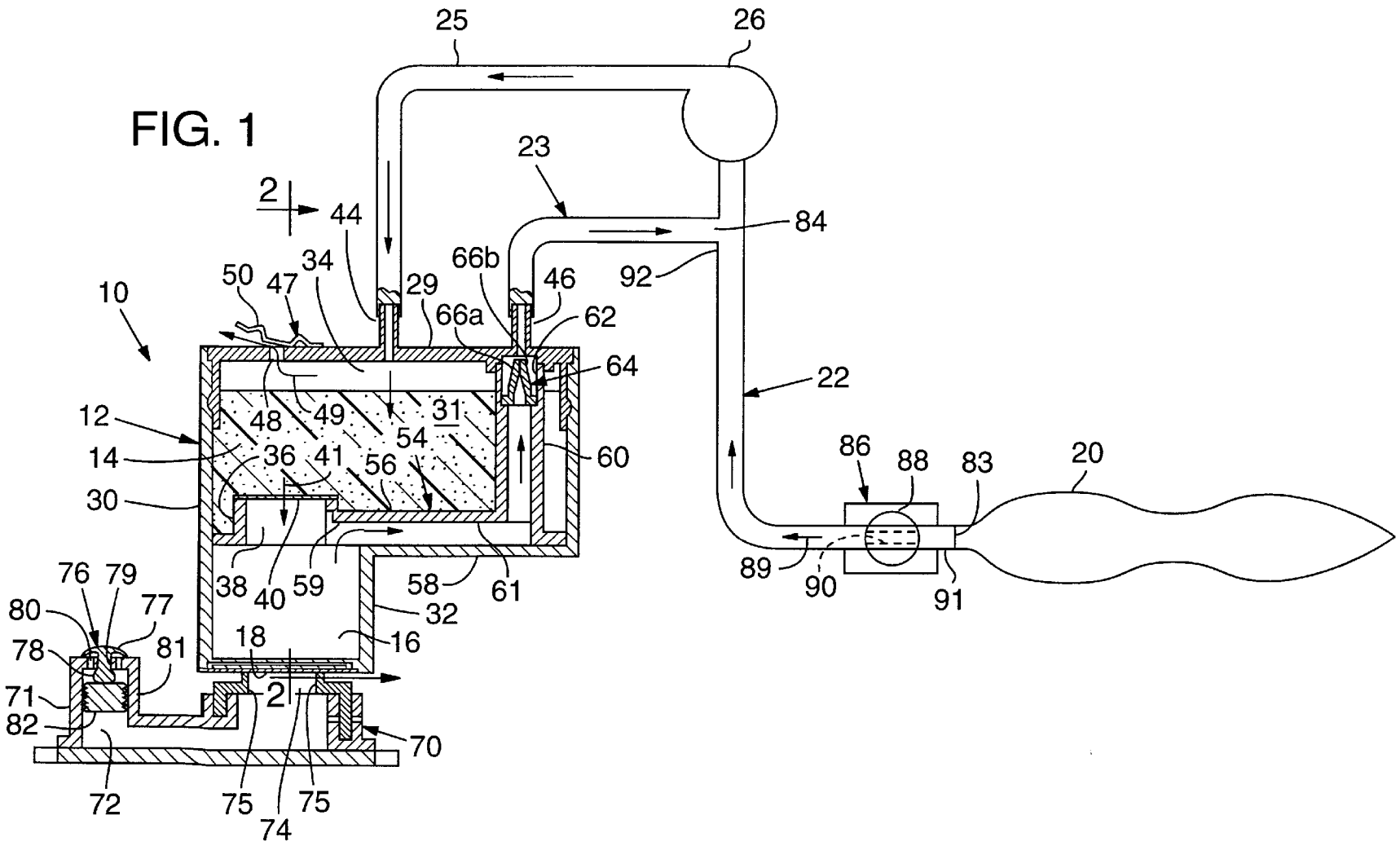
FIG. 1 is a cross-sectional view of an ink delivery system in accordance with a preferred embodiment of the present invention.

In accordance with an embodiment of the present invention, an ink-jet pen ink delivery system 10 includes an ink-jet pen cartridge 12 (FIG. 1). The cartridge 12 stores ink under a slight back pressure to prevent ink leakage or drool from the cartridge. The cartridge 12 contains an internal reservoir divided into an ink storage volume 14 and a standpipe volume 16. A print head 18 is mounted on the cartridge 12 adjacent the standpipe volume 16.

An ink circulation conduit comprising conduit portions 23 and 25 connects the standpipe volume 16 and the ink storage volume 14 such that the standpipe volume and ink storage volume are in fluid communication via the circulation conduit.

An ink supply conduit 22 connects an ink supply 20 with the circulation conduit portions 23 and 25. A pump 26 circulates fluid through the circulation conduit moving ink from the ink supply 20 to the ink storage volume 14. The pump draws ink through the cartridge and back to the circulation conduit. Such ink circulation delivers ink to the ink storage volume 14 and the print head 18, removes air bubbles from the pen system, primes the print head, and dissipates heat generated by the print head.

Figure 2:
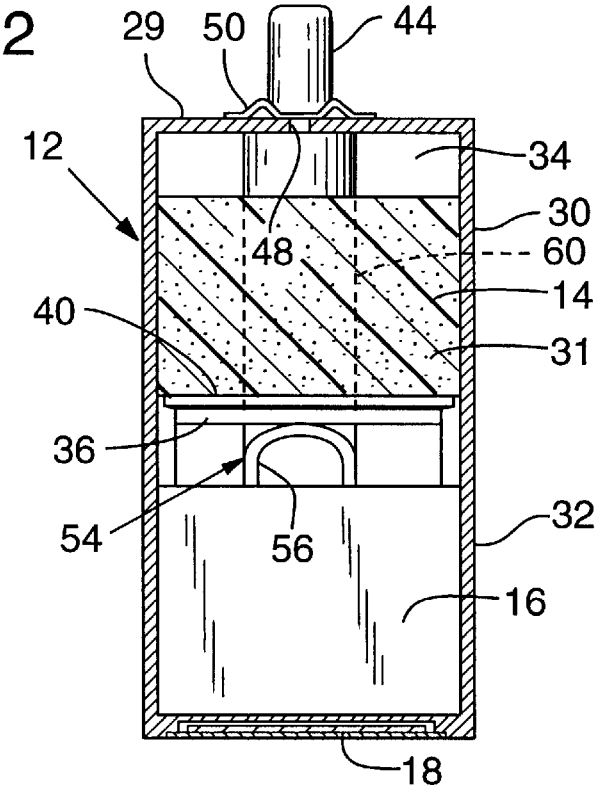
FIG. 2 is a view taken along line 2—2 in FIG. 1, showing aspects of an ink-jet pen in accordance with a preferred embodiment of the present invention.

More particularly, the embodiment of the present invention illustrated in FIGS. 1 and 2 includes an inkjet pen cartridge 12 with a relatively large cartridge body 30. An ink interface wall 29 defines the top of the cartridge body 30. A print head platform 32 extends from the bottom of the body 30 at one end of the body. The standpipe volume 16 is defined within the print head platform 32. Ink storage volume 14 is defined within a portion of the cartridge body 30, between the standpipe volume 16 and a free volume 34 that underlies the interface wall 29 within the cartridge body 30.

A divider wall 36 generally divides the ink storage volume 14 and standpipe volume 16. The ink storage volume 14 is filled with capillary material 31, such as tiny foam balls, fiber bundles or an open-cell hydrophilic foam that serves to hold ink by capillarity and, as a result, establishes a slight back pressure within the reservoir. The relatively small, free volume 34 is above the capillary material 31.

Figure 3:
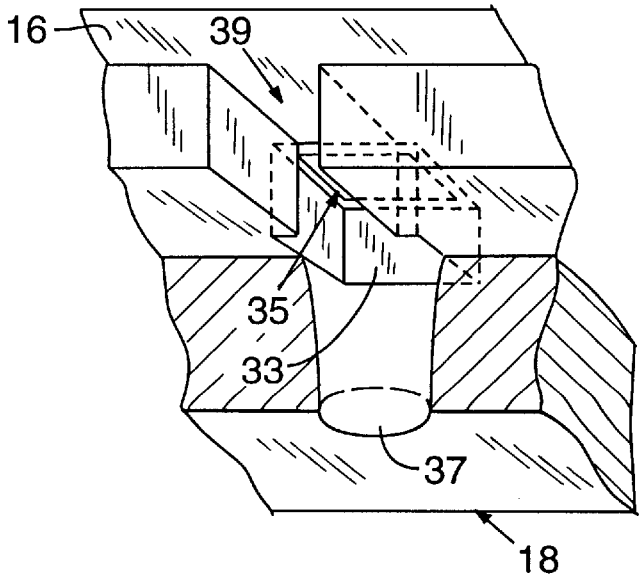
FIG. 3 shows an enlarged, cutaway view of a portion of a print head in accordance with a preferred embodiment of the present invention, depicting a print head firing chamber and nozzle.

The standpipe volume 16 is a free volume (that is, containing no capillary material) in fluid communication with the print head 18. The print head 18 includes a plurality of firing chambers 33, one of which is shown greatly enlarged in FIG. 3. A resistor 35 is mounted within the firing chamber 33 and a nozzle 37 is formed in the print head adjacent to the firing chamber, aligned above the resistor. An inlet passage 39 provides capillary ink flow from the standpipe volume 16 and into the firing chamber 33.

As shown in FIG. 1, an aperture 38 is defined in divider wall 36 to conduct fluid flow from the ink storage volume 14 to the standpipe volume 16 in a direction shown by arrow 41. The aperture 38 is covered by a fine-mesh barrier screen 40 mounted to divider wall 36. The barrier screen 40 filters particulate impurities from ink stored in the ink storage volume 14 to prevent such impurities from clogging the print head nozzles.

A tubular ink inlet fitment 44 and a tubular ink outlet fitment 46 protrude from the interface wall 29. A gas vent 47 is also located on the interface wall. The vent includes a vent orifice 48, defined through interface wall 29, and a check valve 50 mounted to seal the vent orifice (FIG. 2). The check valve 50 preferably comprises a resilient material staked to the interface wall. Free portions of check valve 50 (i.e., unstaked portions) resiliently lift off interface wall 29 to relieve positive pressure in free volume 34 (FIG. 1). Air in free volume 34 may be thus vented through gas vent 47 in direction 49.

Alternatively, gas vent 47 may be omitted. Excess gas bubbles within free volume 34 may be vented through an aperture in the ink interface wall 29. Such an aperture is discussed below in relation to the embodiment of the present invention illustrated in FIG. 8.

In the embodiment shown in FIGS. 1 and 2, ink circulation conduit portion 23 is in fluid communication with an internal conduit 54 within cartridge 12 that is, in turn, in fluid communication with standpipe volume 16. A first portion 56 of internal conduit 54 is generally semi-circular in shape and is attached to cartridge wall 58 at the bottom of the body 30. A first end 59 of the first portion 56 opens to the top of standpipe volume 16. The opening at the top of the standpipe volume permits the ink delivery system to suck substantially all gas bubbles out of the standpipe volume, as explained below. A tubular second portion 60 of internal conduit 54 extends substantially perpendicularly from the opposite end 61 of the first portion 56. The second portion 60 connects to outlet fitment 46 on interface wall 29.

Figure 4:
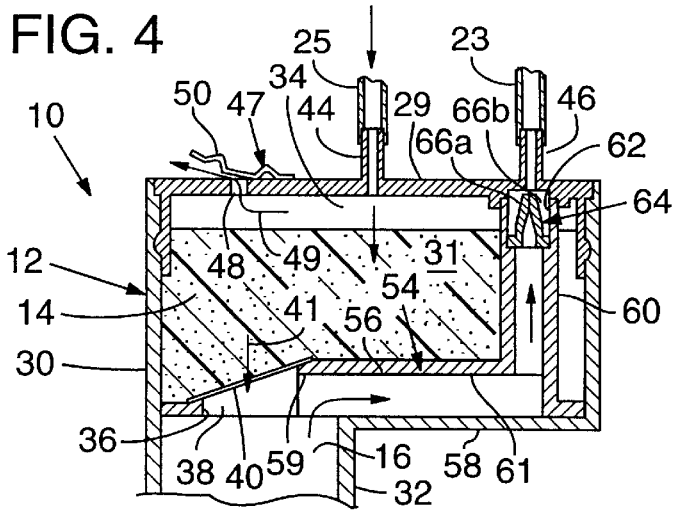
FIG. 4 is a cross-sectional view of an alternative embodiment of the ink delivery system of the present invention.

In an alternative embodiment of the present invention, barrier screen 40 is mounted to barrier wall 36 at an incline, as shown in FIG. 4. With barrier screen 40 mounted at an incline, gas bubbles in the standpipe volume 16 congregate at the higher region of the inclined screen rather than congregating at and covering a substantial portion of the screen 40, as occurs when such screen is mounted in a substantially horizontal configuration. When ink is circulated through the pen, gas bubbles that congregate at the higher portion of the barrier screen 40 are readily drawn through internal conduit 54 and are vented from the system. With the barrier screen 40 configured at an incline, constant fluid communication is established between storage volume 14 and standpipe volume 16, as gas bubbles do not cover the screen and form a barrier to liquid flow therethrough.

Figure 5A:
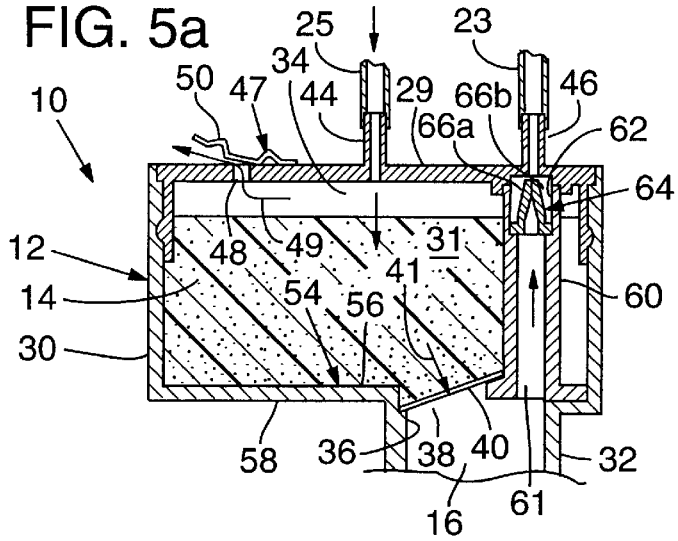
FIG. 5*a* is a cross-sectional view of another alternative embodiment of the ink delivery system of the present invention.

In another embodiment of the present invention, the platform 32 and second portion 60 of internal conduit 54 are contiguous, and the barrier screen 40 is mounted at an incline adjacent to and below the tubular second portion 60 (FIG. 5*a*). With such a configuration, internal conduit 54 no longer includes first portion 56. As described above, gas bubbles that would collect on and block fluid flow through a horizontally mounted barrier screen 40, move in a direction toward the higher portion of the inclined screen and second portion 60. Gas bubbles then move up tubular second portion 60, in a direction toward outlet fitment 46. Such a configuration allows efficient and effective removal of gas bubbles from the pen system and ensures constant fluid communication between ink storage volume 14 and standpipe volume 16.

In another embodiment of the present invention (shown in FIG. 5*b*), an aperture is positioned to extend along a portion of tubular second portion 60, adjacent ink storage volume 14, and covered by barrier screen 40. Accordingly, the barrier screen 40 is mounted substantially vertically. With the barrier screen 40 mounted vertically (as compared to a horizontally positioned barrier screen) gas bubbles will not congregate on the screen and block ink passage therethrough.

Figure 5B:
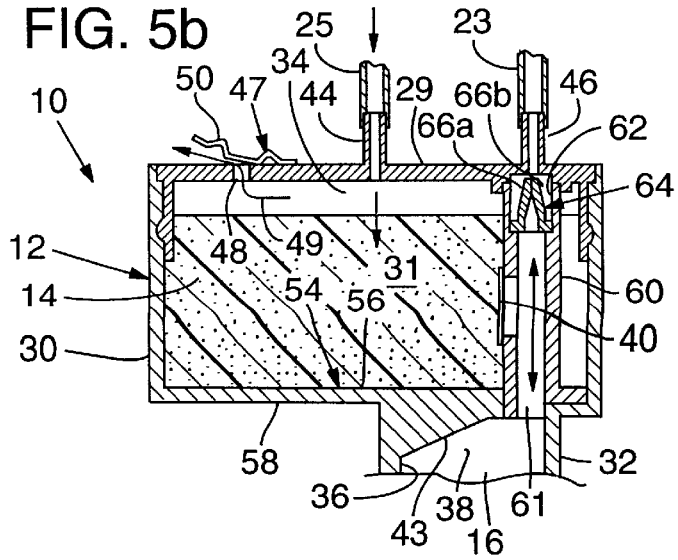
FIG. 5*b* is a cross-sectional view of another alternative embodiment of the ink delivery system of the present invention.

In the embodiment shown in FIG. 5*b*, fluid communication is established between the ink storage volume 14 and the standpipe volume 16 via the aperture and vertically positioned barrier screen 40. Divider wall 36 extends the length of the lower portion of the ink storage volume 14, prohibiting direct fluid communication between the lower portion of the ink storage volume 14 and the standpipe volume 16. The lower surface 43 of divider wall 36 forms an incline at an upper end of standpipe volume 16. The inclined surface 43 has a positive slope in a direction toward tubular second portion 60. Inclined surface 43 causes gas bubbles in the standpipe volume 16 to congregate at the higher region of the inclined surface and eventually move into tubular second portion 60. The gas bubbles are circulated through tubular second portion 60 and are vented out of the system.

Returning to the ink delivery system shown in FIG. 1, second portion 60 of the internal conduit 54 has an enlarged interior diameter 62 adjacent outlet fitment 46 for housing a check valve 64 (FIG. 1). The check valve 64 may be of "duckbill" configuration with an opposed pair of flaps 66*a*, 66*b* that are resiliently biased against each other in order to permit fluid flow out of the cartridge. When an adequate pressure gradient is established across valve 64, fluid may pass out of cartridge 12 through check valve 64. Check valve 64 automatically closes to prevent fluid leakage from outlet fitment 46 when circulation conduit portion 23 is detached from outlet fitment 46 and the cartridge is removed from the printer.

No check valve is required in the inlet fitment 44 to prevent ink leakage upon cartridge removal. Ink will not leak from the capillary material in ink storage volume 14 as a slight back pressure is established therein, as discussed above.

Figure 6A:
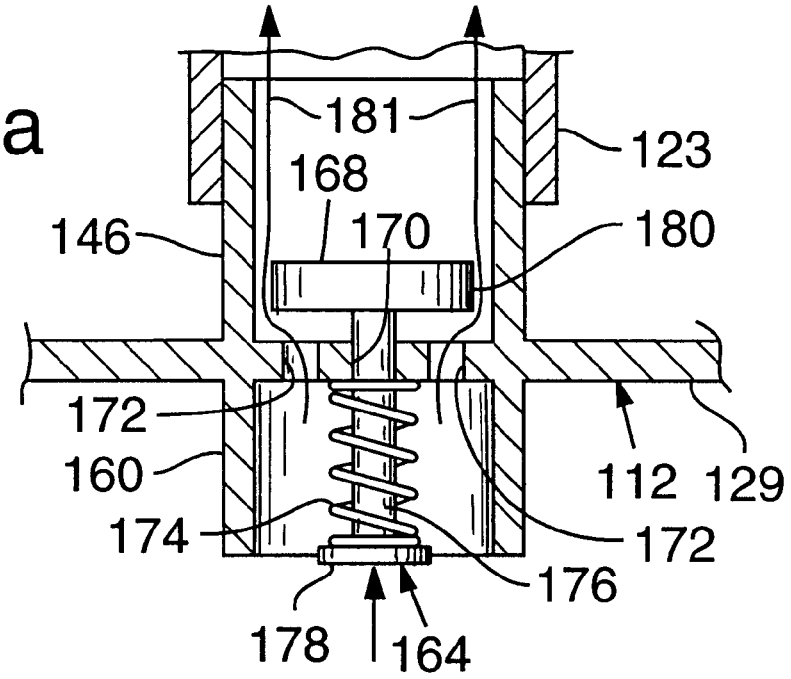
FIG. 6*a* is a cross-sectional view of an alternative valve component of the system in accordance with another preferred embodiment of the present invention.
Figure 6B:
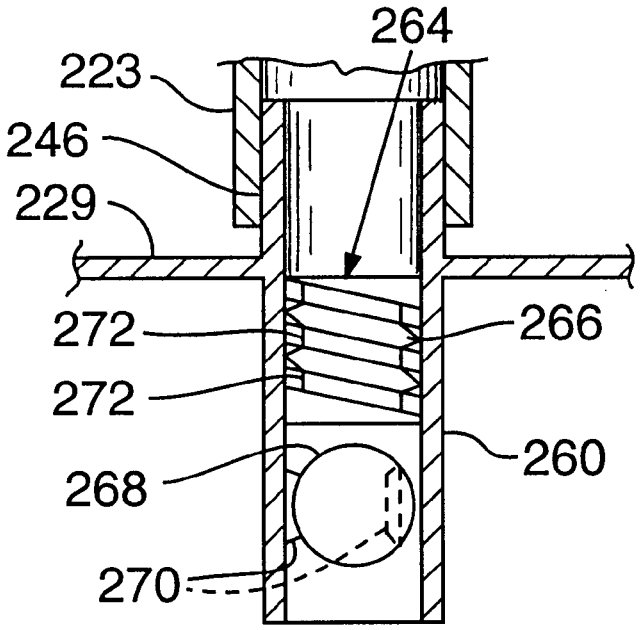
FIG. 6*b* is a cross-sectional view of another alternative valve in accordance with another preferred embodiment of the present invention.

As shown in FIGS. 6*a* and 6*b*, alternative check valves may also used with the present invention. FIG. 6*a* shows a spring-loaded check valve 164 slidably mounted through the cartridge interface wall 129. A plurality of flow apertures 172 are defined through the interface wall about a central aperture 170. A T-shaped valve member 168 has a stem 176 that is slidably mounted through the central aperture 170 such that the cross-member 180 of the T-shaped member may move to seal and unseal the flow apertures.

A coil spring 174 surrounds the stem 176 of the T-shaped member. The coil spring is slightly compressed between the interface wall 129 and a flanged base 178 of the stem 176 to ordinarily bias the cross-member 180 against the interface wall to seal the flow apertures 172. As is shown in FIG. 6*a*, a selected sufficiently high pressure gradient across the valve forces the cross-member 180 away from the interface wall 129 to open the flow apertures 172 to permit fluid flow in direction 181 out of the cartridge.

FIG. 6*b* shows another alternative check valve 264, which includes a spherical member 268. The plug and spherical member are held within the internal conduit portion 260 adjacent the interface wall 229. Three equally-spaced crush ribs 270 extend from the conduit wall to hold the spherical member about 0.001 inch from the conduit wall. The capillary action of ink surrounding the spherical member prevents liquid ink leakage when the outlet figment 246 is disconnected from the circulation conduit 223.

A threaded labyrinth plug 266 may be fitted within the conduit above the spherical member. The plug threads 272 define an elongate spiral path through the conduit portion 260. The path serves as a diffusion barrier to prevent ink dry-out at the spherical member.

Figure 8:
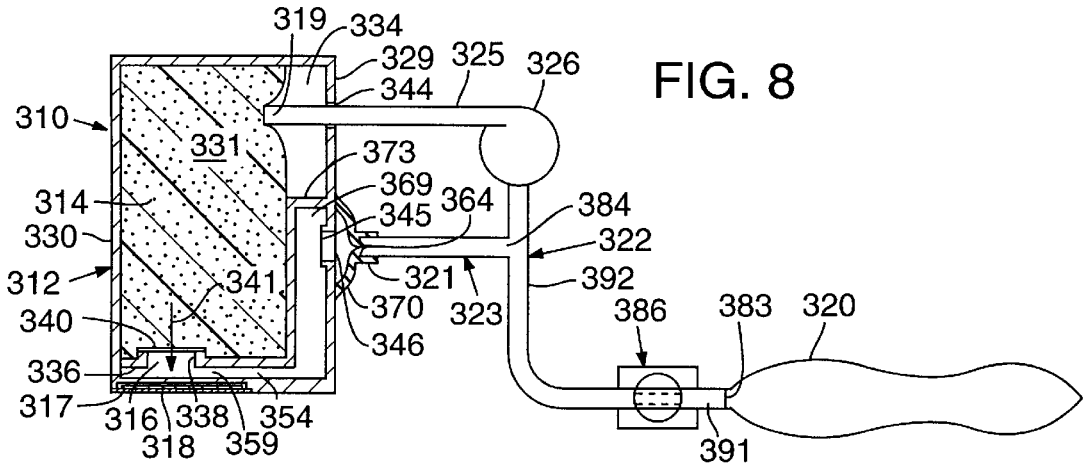
FIG. 8 is a cross-sectional view of another alternative embodiment of the ink delivery system of the present invention.

Alternatively, a screen, such as screen 345 shown in FIG. 8, may take the place of the check valve located between second portion 60 and outlet fitment 46. The screen is preferably of the type having a sufficiently high bubble pressure (e.g., a fine mesh) to prevent air in-flow under ambient conditions, yet large enough mesh to let gas bubbles through the screen.

Returning to the ink delivery system shown in FIG. 1, a capping station 70 is provided for sealing the print head 18 to prevent fluid flow therethrough and to prevent ink from drying within the nozzles. The capping station 70 engages the cartridge 12 to seal the print head when printing operations are not underway. The capping station and/or the cartridge 12 is moved to unseal the print head when printing operations are to begin. The capping station sealing of print head 18 permits the establishment of a back pressure in the standpipe volume 16 that will draw ink into the standpipe volume while drawing little or no air through the nozzles.

The capping station has a body 71 defining an internal volume 72. A capping aperture 74 defined in the body is open to the internal volume. The aperture 74 is surrounded by a resilient gasket 75. Gasket 75 preferably comprises a substantially flat rubber member supported by a raised portion of capping station 70. The gasket 75 mates with the periphery of the print head 18 to enclose all of the print head nozzles 37 (FIG. 3) in communication with the internal volume 72. The internal volume provides a humid atmosphere for the nozzles to prevent nozzle dry-out during storage.

An umbrella valve 76 is disposed within a cylindrical valve housing 81 that protrudes from the capping station body 71. The umbrella valve relieves any excessive over-pressure that develops within the internal volume 72. The umbrella valve 76 has a resilient dome 77 and a relatively thick, plug-like resilient stem 78. The stem 78 is snugly mounted within a stem aperture 79 in valve housing 81. A plurality of valve flow apertures 80 surround the stem aperture. The periphery of the dome 77 is urged against the body 71 to seal the valve flow apertures 80 against fluid flow into the capping station. However, the dome 77 may be resiliently blown back by over-pressure within the internal volume 72 to permit relief of such over-pressure.

A threaded labyrinth plug 82 may be disposed within the valve housing 81 beneath the umbrella valve 76. The labyrinth plug provides an elongate spiral flow path for gas bubbles exiting through the umbrella valve 76.

In an alternative embodiment capping station 70 comprises a substantially flat rubber-face member. The flat rubber-face member would be of a size sufficient to cover and seal all of the nozzles when the pen is capped. Such a seal would be less apt to introduce air to the nozzles when the print head is seated on the capping station. Additionally, a flat rubber-face seal will build a slight back pressure within the pen when the system is primed (discussed below). Thus, when the print head is unseated from the capping station, ink is not drawn from the nozzles.

The ink supply 20 is shown with a bag-like configuration (FIG. 1). The ink bag construction is preferably limp, and does not store ink under a back pressure within. Such an ink bag may be one of a variety known in the art. The ink bag has a fluid connection 83 to one end 91 of the ink supply conduit 22. The opposite end 92 of the ink supply conduit connects at T-section 84 to the circulation conduit 23.

A transport valve 86 is disposed in the ink supply conduit 22 adjacent the ink supply 20. The transport valve 86 may be a rotary-type valve with a rotatable member 88 within which a valve orifice 90 is defined. As shown in FIG. 1, when the rotatable member is positioned with the valve orifice aligned with the ink supply conduit 22, ink is permitted to flow in direction 89 from the ink supply 20 through the transport valve 86. Alternatively, the transport valve 86 may be one of any variety known in the art wherein the valve has a first position to allow fluid flow from the ink supply 20 to the circulation conduit and a second position to occlude fluid flow from the ink supply. The pump 26 is positioned intermediate of the connection of the ink supply conduit 22 and the cartridge inlet fitment 44. The pump 26 may be one of a variety known in the art.

Figure 7:
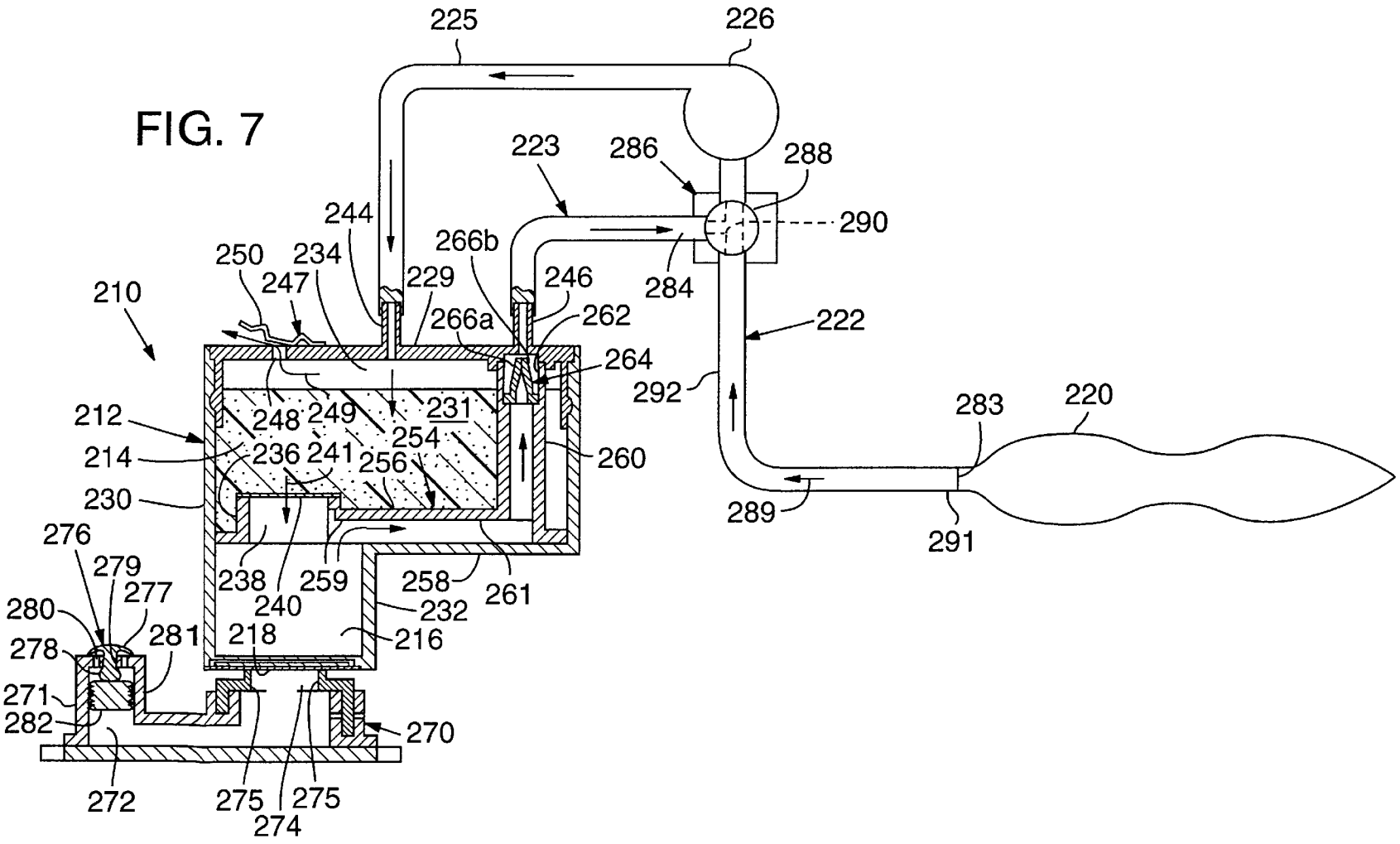
FIG. 7 is a cross-sectional view of another alternative embodiment of the ink delivery system of the present invention.

In an alternative embodiment, a transport valve 286 is positioned at T-section 284, between pump 226, ink supply 220, and outlet fitment 246, with a circulation conduit including conduit portions 223, 225 (FIG. 7). The rotatable member 288 may be positioned with valve orifice 290 aligned with the ink supply conduit 222 and the pump 226, whereby ink may be pulled from the ink supply 220, but not from the cartridge 212. Valve orifice 290 may also be aligned with outlet fitment 246 and pump 226. In this position the pump will pull ink only from the cartridge 212, not from ink supply 220. Additionally, valve orifice 290 may be aligned in a manner to prevent ink flow therethrough from either supply 220 or from the pen. In this position, a closed position, a static meniscus is established at the print head and the printer may be transported while minimizing the likelihood of ink leakage from the pen.

In another embodiment of the present invention, an ink circulation conduit 323 is detachable from the pen. As with the previous embodiments, the ink delivery system shown in FIG. 8 delivers ink to the ink storage volume 314 and the print head 318, removes gas bubbles from throughout the pen system, primes the print head and dissipates heat generated within the pen.

The embodiment depicted in FIG. 8 includes an ink-jet cartridge 312 with a relatively large cartridge body 330. The body includes a bottom wall 317 to which is mounted a print head 318. A standpipe volume 316 is defined within the lower portion of the body 330, adjacent to bottom wall 317, aligned above print head 318. The standpipe volume 316, although referred to as a standpipe, need not be shaped as a pipe. Standpipe volume 316 may be very small without reducing print quality because of the efficiency of the present ink delivery system. Ink storage volume 314, having ink storage material 331, is substantially similar to ink storage volume 14 discussed above.

Standpipe volume 316 is a free volume (that is, standpipe volume 316 contains no storage material) and is in fluid communication with print head 318. The print head 318 may be identical to print head 18 shown in FIG. 3 and described above. Ink stored in the standpipe volume 316 will flow into the print head firing chambers by capillary action.

A divider wall 336 divides the ink storage volume 314 and the standpipe volume 316. An aperture 338 is defined in divider wall 336 along a portion of bottom wall 317. Fluid flows in a direction 341 from the ink storage volume 314 to the standpipe volume 316. The aperture 338 is preferably covered by a fine-mesh barrier screen 340 mounted to the divider wall 336. The screen facilitates the filtering of particulate impurities from the ink in the ink storage volume, preventing such impurities from clogging the print head nozzles.

A free volume 334 extends along a portion of one side of the cartridge body 330 defined by side wall 329. Specifically, free volume 334 is located between an upper portion of capillary material 331 and an upper portion of side wall 329. An ink inlet 344 is defined through an upper portion of side wall 329 and is in fluid communication with free volume 334. Ink inlet 344 is preferably slightly larger in diameter than the diameter of an ink delivery nozzle 319 (described below), such that there is a "loose" fit when the ink delivery nozzle is inserted through the ink inlet. Gas bubbles collecting within free volume 334 may then be vented through the ink inlet 344 even while ink delivery nozzle 319 is inserted therethrough. No valve is required in the ink inlet 344 to prevent ink leakage therefrom. As discussed above, ink does not leak through the ink inlet due to the back pressure established within the pen cartridge. Gas bubbles from free volume 334 may also be vented in a variety of other manners, such as through vents as discussed in relation to the embodiments described above.

The ink delivery system shown in FIG. 8 also includes an internal conduit 354 within cartridge 312, the internal conduit 354 being in fluid communication with standpipe volume 316. Internal conduit 354 is generally semi-circular in shape. However, other configurations are sufficient as long as fluid may flow therethrough. The internal conduit 354 extends horizontally from a first end 359 adjacent the print head 318 along bottom wall 317, and extends vertically to a second end 369 adjacent free volume 334. A partition wall 373 positioned between free volume 334 and the second end 369 of internal conduit 354, prevents fluid communication therebetween.

Figure 9:
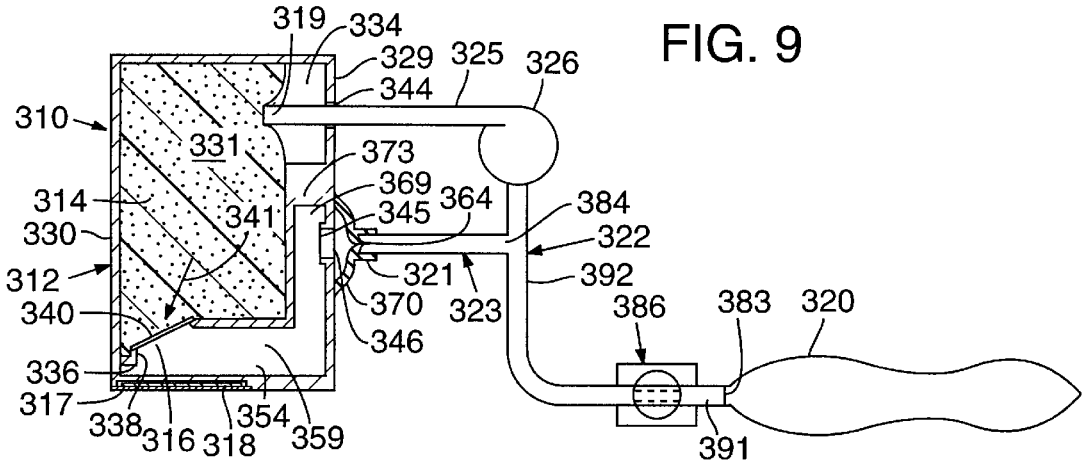
FIG. 9 is a cross-sectional view of another alternative embodiment of the ink delivery system of the present invention.

In an alternative embodiment of the present invention, barrier screen 340 is mounted at an incline within cartridge 312 (FIG. 9). As discussed above in relation to the embodiment shown in FIG. 4, with barrier screen 340 mounted at an incline, gas bubbles move in an upward direction such that barrier screen 340 will not become substantially covered with gas bubbles. Inclined orientation of the screen 340 allows continuous fluid communication between storage volume 314 and standpipe volume 316.

Figure 10:
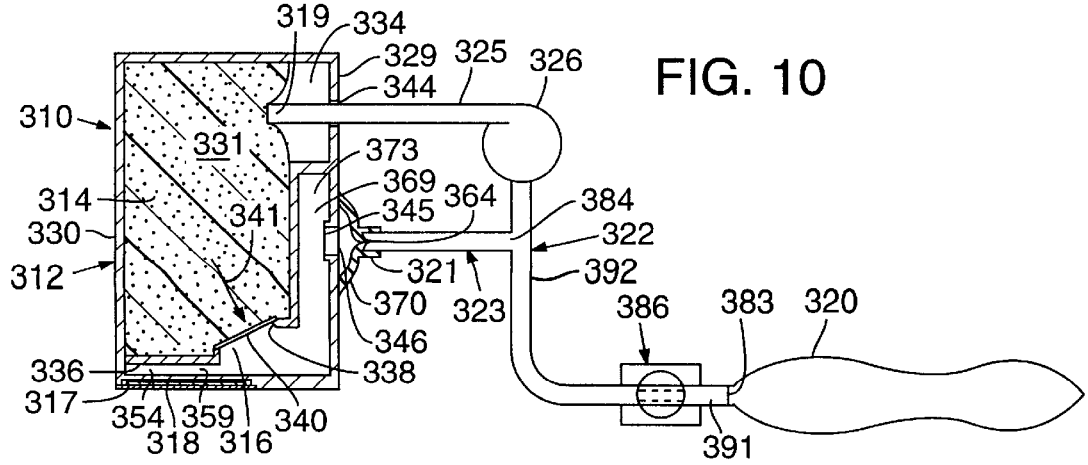
FIG. 10 is a cross-sectional view of another alternative embodiment of the ink delivery system of the present invention.

Alternatively, as shown in FIG. 10, barrier screen 340 may be mounted at an incline, adjacent to and below second end 369 of internal conduit 354. Such a configuration has the same advantages as that discussed above in relation to the embodiment shown in FIG. 5*a*.

Returning to the embodiment shown in FIG. 8, adjoining the second end 369 of internal conduit 354 is fluid exit orifice 346 defined in side wall 329. Mounted to exit orifice 346 is a fine-mesh, stainless steel screen 345. Screen 345 has openings sized such that gas bubbles may be drawn therethrough, although gas bubbles will not flow through the screen under ambient (not pumped) conditions.

An ink circulation conduit 323 connects the standpipe volume 316 and the ink storage volume 314 such that the standpipe volume and ink storage volume are in fluid communication via the circulation conduit 323. An ink supply conduit 322 connects an ink supply 320 with the ink circulation conduit 323. A pump 326 circulates fluid through the circulation conduit 323 by moving ink from the ink supply 320, through an ink delivery conduit 325 and to the ink storage volume 314 within the pen reservoir. Fluid is moved by pump 326 through the pen cartridge 312 and out exit orifice 346.

A compliant cup fitting 370, having a diameter at least slightly larger than the diameter of exit orifice 346, is connected to a conduit end 321 of ink circulation conduit 323. In an alternative embodiment, conduit end 321 may be extended such that conduit end 321 is in intimate contact with screen 345. Due to the capillary force of screen 345, ink remaining in the tip of conduit end 321 is drawn therefrom upon removal of circulation conduit 323.

Cup fitting 370 may comprise any resilient material sufficiently compliant such that a seal is created when the cup fitting is pressed against side wall 329 to cover exit orifice 346. Housed within cup fitting 370 is a check valve 364, such as the duck bill valve 64 described above. Check valve 364, however, may comprise any valve capable of automatically closing to prevent fluid leakage from exit orifice 346 when circulation conduit 323 is detached therefrom.

Capillary material 331 may be slightly compressed by an ink delivery nozzle 319 of the ink circulation conduit 323 as the delivery nozzle 319 is inserted into the pen cartridge. Compression of the capillary material increases the capillary force of the capillary material causing ink to be pulled from the tip of the ink delivery nozzle 319 as ink circulation conduit 323 is detached from the pen cartridge. The removal of ink from the tip of the nozzle as the ink circulation conduit is detached from the pen inhibits ink leakage therefrom. Compression of capillary material 331 also decreases the capillary material volume, thereby establishing a back pressure in the ink-jet pen as the compression of the capillary material is released.

Ink supply 320 is shown with a bag-like configuration. The ink bag has a fluid connection 383 at one end 391 of the ink supply conduit 322. The opposite end 392 of the ink supply conduit connects at T-section 384 to the circulation conduit 323. A pump 326 is positioned intermediate the connection of ink supply conduit 322 and ink inlet 344. A transport valve 386 is disposed in the ink supply conduit adjacent the ink supply 320. Alternatively, transport valve 386 may be positioned at T-section 384, between the pump 326, the ink supply 320, and the check valve 364. The transport valve 386 operates as discussed above in relation to the embodiment illustrated in FIG. 7.

The ink delivery system illustrated in FIG. 8 may be permanently attached to the pen. If the ink delivery system of FIG. 8 is permanently attached, ink supply conduit 322 preferably comprises a flexible tubing of sufficient length to accommodate a reciprocating pen cartridge.

Alternatively, the ink circulation conduit 323 illustrated in FIG. 8 may be intermittently attached to the pen whenever gas bubble removal, heat dissipation, priming of the print head and/or ink delivery (refilling) is required. When the ink circulation conduit 323 is attached to the pen, compliant cup fitting 370 fits firmly against the outside of exit orifice 346 and ink delivery nozzle 319 is inserted through ink inlet 344. Ink is delivered to ink storage volume 314 and/or fluid is circulated through the pen system for the required period of time. The ink circulation conduit is detached when the pen cartridge is sufficiently filled with ink, gas bubbles are removed, heat is dissipated and/or the print head is primed.

Figure 11A:
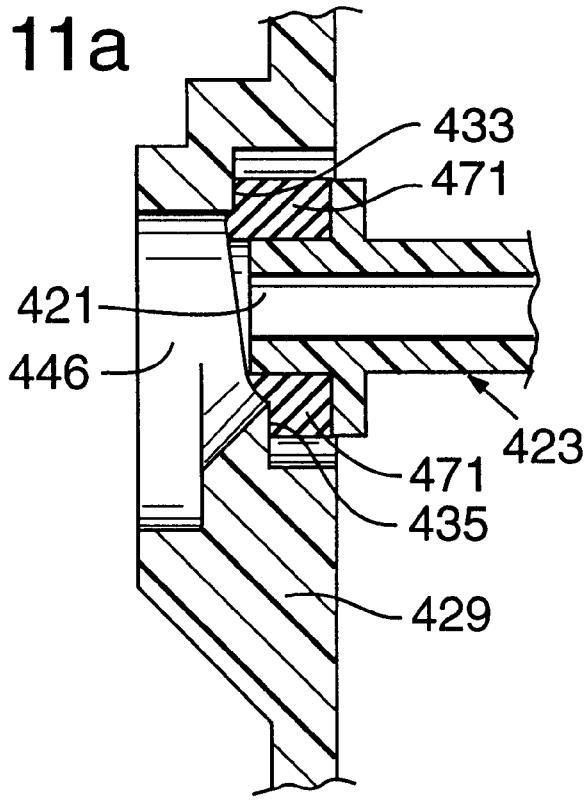
FIG. 11*a* is a cross-sectional view of another alternative embodiment of the ink delivery system of the present invention wherein the ink circulation conduit is in a sealed position.
Figure 11B:
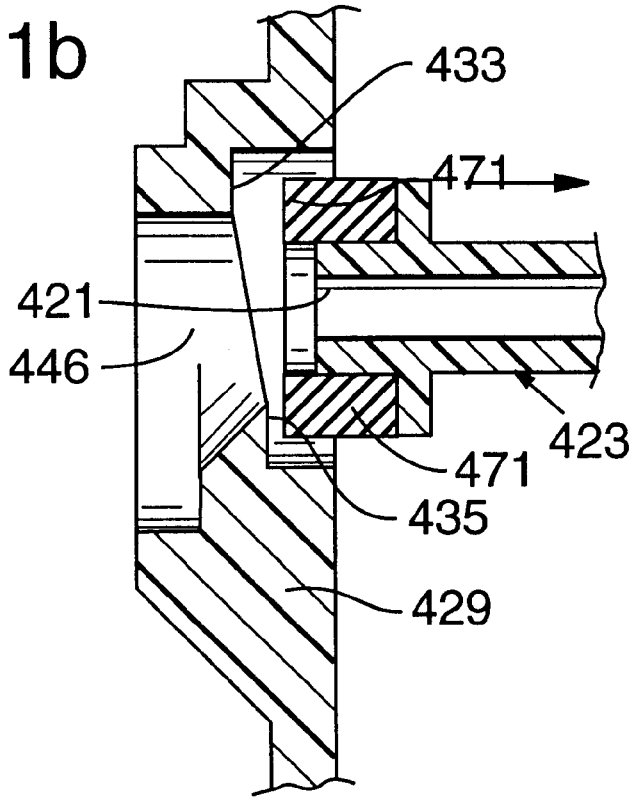
FIG. 11*b* is a cross-sectional view of another alternative embodiment of the ink delivery system of the present invention wherein the ink circulation conduit is in a partially retracted position.

In an alternative embodiment (shown in FIGS. 11*a* and 11*b*), ink circulation conduit 423 is removably connected to the pen cartridge interface wall 429 such that a seal is created when a compliant material 471 of the circulation conduit is pressed against the interface wall to cover exit orifice 446 (FIG. 11*a*). A continuous fluid path from the pen cartridge, through the exit orifice 446, and to the ink circulation conduit 423 is formed when the circulation conduit is connected to the pen cartridge. An upper portion 433 of exit orifice 446 is canted relative to a lower portion 435 of the exit orifice. With such a canted configuration, upon removal of ink circulation conduit 423, the seal between compliant material 471 and upper portion 433 of the exit orifice 446 is broken prior to breaking the seal between compliant material 471 and lower portion 435 of the exit orifice. Accordingly, as the ink circulation conduit 423 is removed from the pen cartridge, excess ink in a conduit end 421 of the ink circulation conduit is drawn into the pen cartridge rather than remaining in the circulation conduit and leaking therefrom.

Operation

For clarity, operation of the ink delivery system is described in terms of the embodiment illustrated in FIG. 1. All of the embodiments of the present invention operate in a substantially similar manner, unless otherwise indicated.

The ink delivery system of the present invention may be operated in a continuous or a discontinuous mode. That is, fluid may be circulated through the pen cartridge only when necessary to deliver ink to the pen, remove gas bubbles from or dissipate heat within the pen cartridge. Alternatively, fluid may be continuously circulated through the pen cartridge thereby continually removing gas bubbles and dissipating heat while assuring a steady supply of ink to the pen and allowing a faster print speed (i.e., the pen does not need to stop printing for refill).

Discussed first is ink delivery to and priming of a pen cartridge that has some ink previously stored therein. Following is a description of ink delivery to and priming of a pen cartridge having a dry print head 18 and a completely dry ink storage volume 14. Referring to FIG. 1, the priming operation begins with the activation of the pump 26 while the transport valve 86 is in the closed position, and the print head 18 is sealed by the capping station 70. Substantially dry capillary material 31 provides a flow restriction to ink flow through the barrier screen 40 so that back pressure is established upstream of the pump in the circulation conduit portion 23, supply conduit 22 and standpipe volume 16. The capping station 70 permits the establishment of the back pressure with little or no air being drawn inward through the nozzles 37. Any air possibly sucked through the nozzles from the capping station internal volume 72 will be vented from the system as described below.

The transport valve 86 is then moved to the open position, and the pump 26 draws ink from ink supply 20 and moves ink through the supply conduit 22, pump 26 and inlet fitment 44. Because the capillarity of the capillary material 31 establishes a flow resistance within the pen cartridge, the pump will pull ink from the ink supply 20, the source with the lower resistance. The ink bag and supply conduit may be formed to provide only a small amount of flow resistance so that ink is pumped from the ink bag under a selected, relatively low back pressure.

The ink entering the cartridge through the inlet fitment passes through the free volume 34 and is quickly absorbed by the capillary material 31 in the capillary material filled ink storage volume 14. Once the capillary material becomes saturated with ink, the fluid flow resistance through the capillary material decreases such that the suction required to draw ink through the capillary material is less than the suction required to draw ink from the ink supply 20. At this point, the pump will draw fluid through the capillary material 31 and cease pulling ink from the ink supply 20. Ink and gas bubbles are then drawn through the barrier screen 40 and pass to the bottom of the standpipe volume 16 adjacent the print head 18. Thus, gas bubbles are sucked from all points within the pen cartridge including from the standpipe volume. The ink circulation system of the present invention permits gas bubbles to be sucked from the standpipe volume and print head.

Gas bubbles sucked from the ink-saturated capillary material and the standpipe volume, as well as gas bubbles in the ink circulation conduit, is gradually vented out gas vent 47. Such venting is made possible by the establishment of a slight positive pressure in free volume 34. Such positive pressure is established by the action of the pump 26 and the flow resistance of the capillary material 31. Thus, gas bubbles that are drawn out of the capillary material, standpipe volume and print head is pumped into free volume 34, where they are essentially trapped adjacent the ink saturated capillary material at a positive pressure for venting out the gas vent 47. In this way, substantially all the gas bubbles initially located within the capillary material filled ink storage volume 14, the standpipe volume 16, and circulation conduit are eventually vented through the gas vent as liquid ink fills the ink-filled volume, standpipe volume, and-circulation conduit.

When there is no ink stored within the capillary material filled ink storage volume (i.e., the capillary material is completely dry) or elsewhere in the pen cartridge 12, the pen cartridge does not provide sufficient fluid flow resistance to cause pump 26 to pull ink from the ink supply 20. Rather, gas bubbles are easily pulled through the capillary material 31 and, hence, through ink circulation conduit 23. The gas bubbles are then circulated back into the capillary material. Accordingly, the present invention provides several methods to prompt the ink delivery system into a state of delivery and circulation of ink through the pen cartridge even when the pen cartridge is completely dry.

A completely dry ink storage volume may be filled and the print head primed by utilizing the "closed" position of the transport valve. In the embodiment shown in FIG. 7, the transport valve is disposed at the T-section 284. Valve orifice 290 may be aligned such that ink is permitted to flow from ink supply 220, not from cartridge 212. Pulling ink only from ink supply 220 allows filling of a completely dry capillary material and priming of a print head without drawing gas bubbles through the cartridge.

Alternatively, ink may be delivered to a completely dry pen cartridge and the cartridge primed by employing an initial, relatively fast pump rate. Such a pumping rate increases the dynamic flow resistance of the pen cartridge such that ink is pulled from the source of lower resistance, the ink supply rather than gas bubbles being pulled through the dry pen cartridge. Installation of a new pen may be set to trigger such a fast pumping rate.

A completely dry pen cartridge such as in the embodiment illustrated in FIG. 8 may, alternatively, be filled and primed by use of a removable impediment that imposes a sufficient flow resistance to the pen. Such an impediment may comprise a self-adhesive seal placed over ink exit orifice 346. Such an impediment would force pump 326 to pull ink from ink supply 320 (the source of lower resistance) rather than draw gas bubbles through the pen cartridge. After a sufficient volume of ink is delivered to the ink storage volume 314 ink circulation conduit 323 is disconnected from the pen cartridge and the printer operator is instructed to remove the impediment. Circulation of ink through the pen cartridge may then be continued until the ink storage volume 314 is saturated with ink, and gas bubbles are removed from the system.

A completely dry ink delivery system of the present invention may also be filled and primed by wetting the exit orifice screen with a low vapor pressure liquid compatible with the ink system. Preferably, the low vapor pressure liquid is also a constituent of the ink composition employed in the pen. Such liquid establishes the necessary initial back pressure in the pen cartridge to cause the pump to pull ink from the external ink source, the lower pressure source, rather than pull gas through the cartridge. Such liquid would require little or no special packaging and would not shorten the cartridge shelf life. After ink is delivered to the dry pen cartridge, the transport valve may be closed to facilitate priming of the print head and removal of gas bubbles from the pen cartridge. Pumping may continue for a time period sufficient to substantially saturate the ink storage volume and to fill the standpipe volume. At this point, the transport valve may be aligned to force the pump to suck out any trapped gas bubbles in the pen cartridge. The transport valve may remain in such a position until the next refilling sequence or may proceed to continuously circulate fluid through the pen cartridge.

Alternatively, the barrier screen, rather than the exit orifice screen, may be wetted with a low vapor pressure liquid. A wetted barrier screen creates an initial back pressure in the cartridge such that the pump pulls ink from the lower pressure source, the ink supply, rather than pulling gas bubbles through the dry cartridge. Saturating the screen with such liquid aids in priming a pen, including a pen having a completely dry capillary material.

A combination of saturating the barrier screen with an appropriate liquid, and utilizing a removable impediment such as a seal placed over the exit orifice, enables the pen to withstand extended storage periods while providing for filling of a completely dry pen cartridge and for priming of the pen.

Having illustrated and described the principles of the invention, it should be apparent to persons skilled in the art that the illustrated embodiments may be modified without departing from such principles. We claim as our invention all such embodiments that may come within the scope and spirit of the following claims and equivalents thereto.

We claim:

1. An ink delivery system for an ink-jet pen comprising:

a pen cartridge having an internal reservoir for storing ink, a fluid inlet in fluid communication with the reservoirs and a fluid outlet in fluid communication with the reservoir;

a print head mounted to the pen cartridge, in fluid communication with the reservoir and the fluid outlet;

an ink supply;

a conduit system coupled to the ink supply, the conduit system connected to the fluid inlet and the fluid outlet during an operational mode;

a pump connected to the conduit system, the pump adapted to selectively deliver ink from the ink supply to the reservoir and to circulate fluid from the conduit system through the pen cartridge and back to the conduit system;

and wherein the ink supply has a first fluid flow resistance to ink being delivered from the ink supply to the reservoir by the conduit system, the pen cartridge has a second fluid flow resistance to fluid circulation therethrough, the second fluid flow resistance being greater than the first fluid flow resistance whenever the reservoir is partially filled with ink, and the pump moves ink from the ink supply to the reservoir only when the second fluid flow resistance is greater than the first fluid flow resistance, while maintaining fluid communication between the reservoir and the conduit system, and between the ink supply and the conduit system.

2. The system of claim 1 wherein:

the reservoir has a first volume and a second volume, the first volume adjacent to and in fluid communication with the second volume, the first volume substantially filled with a capillary material for storing ink therein.

3. The system of claim 2 wherein:

the reservoir further includes a third volume adjacent the print head, the third volume in fluid communication with the first volume and the second volume; and the pump moves fluid through the first volume to the third volume and then to the second volume to remove gas in the fluid from the third volume.

4. The system of claim 3, wherein a transport valve is disposed in the conduit system, the transport valve having a first position allowing fluid flow from the ink supply through the conduit system and a second position occluding fluid flow from the ink supply.

5. The system of claim 3, wherein:

a transport valve is disposed in the conduit system, the transport valve having a first position allowing fluid flow from the ink supply to the conduit system while occluding fluid flow from the pen cartridge to the conduit system, a second position allowing fluid flow from the pen cartridge to the conduit system while occluding fluid flow from the ink supply, and a third position occluding fluid flow through the conduit system.

6. The system of claim 1 wherein said pen cartridge further includes a gas vent adjacent to the reservoir.

7. The system of claim 6 wherein:

the second fluid flow resistance is less than the first fluid flow resistance whenever the first reservoir volume is substantially saturated with ink; and the pump moves fluid from the conduit system, through the reservoir and back to the ink circulation conduit whenever the second fluid flow resistance is less than the first fluid flow resistance.

8. The system of claim 7 wherein the reservoir has a first volume adjacent to and in fluid communication with a second volume, the first volume substantially filled with a capillary material for storing ink therein, the system further including a screen positioned between the second volume and the fluid outlet, the screen carrying a liquid therein, the liquid in the screen creating a third flow resistance to fluid circulation through the pen cartridge, the third fluid flow resistance greater than the first fluid flow resistance such that the pump moves ink from the ink supply to the reservoir.

9. The system of claim 7 wherein the reservoir has a first volume adjacent to and in fluid communication with a second volume, the first volume substantially filled with a capillary material for storing ink therein, the system further including a removable impediment positioned between the second volume and the fluid outlet, the removable impediment creating a third fluid flow resistance greater than the first fluid flow resistance such that the pump moves ink from the ink supply to the reservoir.

10. The system of claim 7 wherein the pump operates at a first pump rate whenever the first volume has ink stored therein and at a second pump rate whenever the reservoir is substantially dry, the second pump rate being faster than the first pump rate.

11. The system of claim 7 further including a capping station selectively connectable to the print head to cover and seal the print head.

12. The system of claim 1, including a pen cartridge outlet fitment and a pen cartridge inlet fitment, to which the circulation conduit is removably connectable to permit intermittent removal of the circulation conduit from the system.

13. The system of claim 12 including a check valve mounted in the circulation conduit, the check valve being biased towards a closed position to prevent fluid leakage from the circulation conduit when the circulation conduit is removed from the system.

14. The system of claim 12, wherein a compliant material forms a seal between the pen cartridge outlet fitment and the circulation conduit whenever the circulation conduit is connected to the pen cartridge.

15. The system of claim 14 wherein the outlet fitment comprises a canted orifice such that the seal between the pen cartridge outlet fitment and the circulation conduit is broken at an upper portion of the seal prior to a lower portion of the seal when the circulation conduit is removed from the pen cartridge.

16. The system of claim 1 wherein said conduit system includes:

an ink supply conduit portion coupled between said ink supply and said pump, said ink supply conduit including a conduit junction;

a first conduit portion connected between said pump and said fluid inlet of said pen cartridge; and a second conduit portion connected between said fluid outlet of said pen cartridge and said conduit junction, said pump delivering ink through said ink supply conduit portion and said first conduit portion whenever the second fluid flow resistance is greater than the first fluid flow resistance.

17. The system of claim 16 wherein said pump recirculates ink through the first conduit portion, the ink reservoir and the second fluid conduit portion without delivering ink from the ink supply whenever the second fluid flow resistance is less than the first fluid flow resistance.

18. The system of claim 1 wherein the ink supply is remote from the pen cartridge.

19. An ink delivery system for an ink-jet pen comprising:

a pen cartridge having a reservoir for storing ink, the pen cartridge having a first fluid flow resistance therethrough;

a print head mounted to the pen cartridge;

an ink supply having a second fluid flow resistance therefrom;

a conduit system coupled to the ink supply and periodically coupled to the pen cartridge; and a pump connected to the conduit system, the pump selectively moving ink from the ink supply to the reservoir only if the first fluid flow resistance is greater than the second fluid flow resistance and selectively moving fluid through the pen cartridge to the conduit system without delivering ink from the ink supply wherever the second fluid flow resistance is greater than the first fluid flow resistance.

20. The system of claim 19 wherein said conduit system includes:

an ink supply conduit portion coupled between said ink supply and said pump, said ink supply conduit including a conduit junction;

a first conduit portion coupled between said pump and said fluid inlet of said pen cartridge; and a second conduit portion coupled between said fluid outlet of said pen cartridge and said conduit junction, said pump delivering ink through said ink supply conduit portion and said first conduit portion whenever the second fluid flow resistance is greater than the first fluid flow resistance.

21. The system of claim 20 wherein said pump recirculates ink through the first conduit portion, the ink reservoir and the second fluid conduit portion without delivering ink from the ink supply whenever the second fluid flow resistance is less than the first fluid flow resistance.

22. The system of claim 19 wherein the ink supply is remote from the pen cartridge.

23. A method for removing gas from, delivering to, and dissipating heat within an ink-jet pen having an internal reservoir, the method comprising the steps of:

periodically supplying ink to the reservoir from an ink supply remote from the ink-jet pen;

circulating ink from the reservoir through a circulation conduit and back to the reservoir without passing the ink through the ink supply; and venting gas from the reservoir.

24. The method of claim 23 further comprising the steps of:

providing a capillary material in the reservoir and a pump connected to the circulation conduit;

mounting a screen to the reservoir;

pumping ink from an ink supply remote from the pen, through the circulation conduit when the circulation conduit is coupled to the ink-jet pen and into the capillary material within the reservoir until the capillary material is substantially saturated;

pumping fluid through the capillary material back to the circulation conduit whenever the capillary material is substantially saturated; and removing the circulation conduit from the ink-jet pen when the pump is not activated.

25. The method of claim 24 further comprising the step of mounting the screen at an incline.

26. The method of claim 24 further comprising the step of saturating the screen with a fluid providing a relatively high flow resistance in the ink-jet pen such that the pump moves ink from the ink supply to the reservoir whenever the reservoir is dry.

27. The method of claim 24 further comprising the steps of:

pumping fluid at a first pump rate whenever the reservoir is dry such that ink is moved from the ink supply to the pen cartridge; and pumping fluid at a second pump rate, the second pump rate less than the first pump rate whenever the pen cartridge is saturated with ink such that the pump moves fluid from the circulation conduit through the pen cartridge and back to the circulation conduit.

28. The method of claim 23 wherein:

said step of periodically supplying ink comprises the step of pumping ink from the ink supply remote from the ink-jet pen to the reservoir whenever a fluid flow resistance of the ink-jet pen is greater than a fluid flow resistance of the ink supply; and said step of circulating ink comprises the step of pumping fluid from the circulation conduit, through the ink-jet pen, and back to the ink circulation conduit without passing through the ink supply whenever the fluid flow resistance of the ink-jet pen is less than the fluid flow resistance of the ink supply.

* * * * *

UNITED STATES PATENT AND TRADEMARK OFFICE

CERTIFICATE OF CORRECTION

PATENT NO. : 5,936,650
DATED : August 10, 1999
INVENTOR(S) : Ouchida et al.

It is certified that error appears in the above-identified patent and that said Letters Patent is hereby corrected as shown below:

Column 13,
Line 50, delete “reservoirs” and insert therefor -- reservoir --.

Signed and Sealed this

Third Day of February, 2004

JON W. DUDAS
*Acting Director of the United States Patent and Trademark Office*